US005649604A

United States Patent [19]

Fuller et al.

[11] Patent Number: 5,649,604

[45] Date of Patent: Jul. 22, 1997

[54] ROTARY DRILL BITS

[75] Inventors: John M. Fuller, Nailsworth; Andrew Murdock, Stonehouse, both of England

[73] Assignee: Camco Drilling Group Limited, Stonehouse, England

[21] Appl. No.: 538,759

[22] Filed: Oct. 3, 1995

[30] Foreign Application Priority Data

Oct. 15, 1994 [GB] United Kingdom ..... 9420839
Mar. 23, 1995 [GB] United Kingdom ..... 9505923

[51] Int. Cl.[6] ..... E21B 10/46

[52] U.S. Cl. ..... 175/431

[58] Field of Search ..... 175/431, 428, 175/398, 430, 385

[56] References Cited

U.S. PATENT DOCUMENTS

| | | | |
|---|---|---|---|
| 4,244,432 | 1/1981 | Rowley et al. | 175/428 |
| 4,351,401 | 9/1982 | Fielder | 175/428 |
| 4,819,516 | 4/1989 | Dennis . | |
| 4,858,707 | 8/1989 | Jone et al. | 175/428 |
| 4,932,484 | 6/1990 | Warren et al. . | |
| 4,942,933 | 7/1990 | Barr et al. | 175/431 |
| 5,119,892 | 6/1992 | Clegg et al. | 175/431 |
| 5,282,513 | 2/1994 | Jones . | |
| 5,303,785 | 4/1994 | Duke | 175/57 |
| 5,531,281 | 7/1996 | Murdock | 175/431 |

FOREIGN PATENT DOCUMENTS

| | | |
|---|---|---|
| 0029535 | 11/1980 | European Pat. Off. . |
| 0127077 | 12/1984 | European Pat. Off. . |
| 0532869 | 3/1993 | European Pat. Off. . |
| 1336758 | 11/1973 | United Kingdom . |
| 1357640 | 6/1974 | United Kingdom . |
| 2060735 | 5/1981 | United Kingdom . |
| 1596610 | 8/1981 | United Kingdom . |
| 2161849 | 1/1986 | United Kingdom . |
| 2238812 | 6/1991 | United Kingdom . |
| 2273946 | 7/1994 | United Kingdom . |
| 2292163 | 2/1996 | United Kingdom . |
| 9313290 | 7/1993 | WIPO . |

*Primary Examiner*—Frank Tsay

[57] ABSTRACT

A rotary drill bit comprises a bit body having a shank for connection to a drill string, a plurality of cutters mounted on the bit body, each cutter having a cutting face, and means for supplying drilling fluid to the surface of the bit body to cool and clean the cutters. At least some of the cutters are lateral cutters located to act sideways on the formation being drilled, and the cutting faces of such lateral cutters are orientated to exhibit negative side rake and negative top rake with respect to the surface of the formation. The negative side rake angle is greater than 20° and may be as much as 90°, and the negative top rake angle is also more than 20°. A single cutter may include two cutting faces at different negative side rake angles, e.g. the cutter may comprise a generally cylindrical substrate formed at one end with two oppositely inclined surfaces meeting along a ridge, a facing table of polycrystalline diamond being bonded to the substrate surfaces and extending over the ridge.

23 Claims, 4 Drawing Sheets

FIG 4
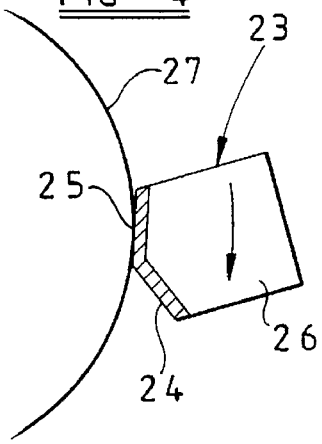
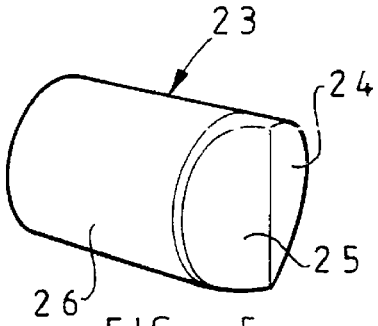
FIG 5
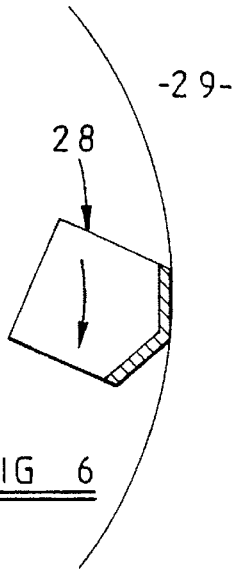
FIG 6
FIG 7
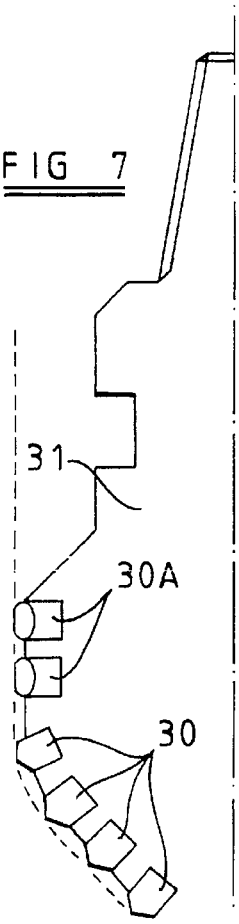
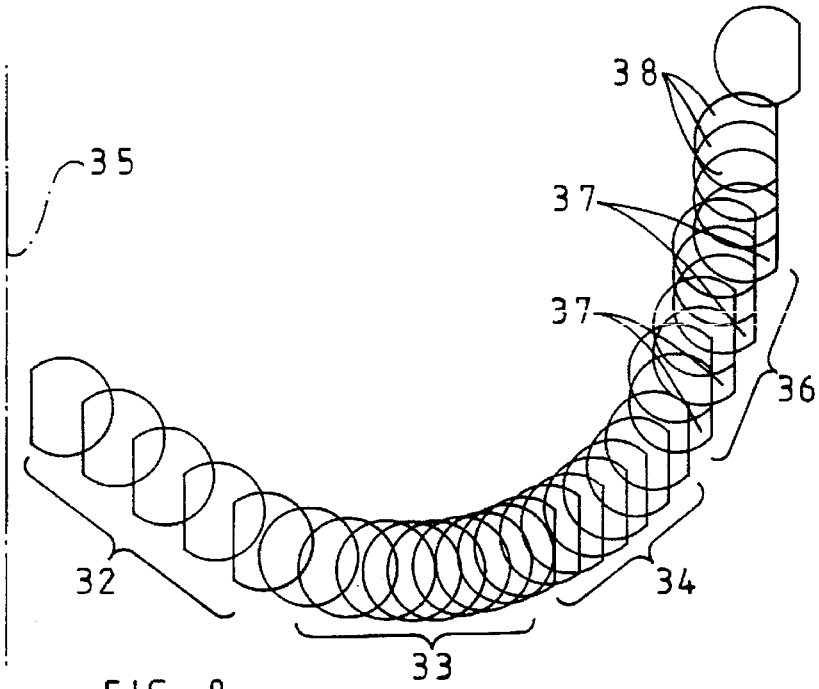
FIG 8

FIG 9
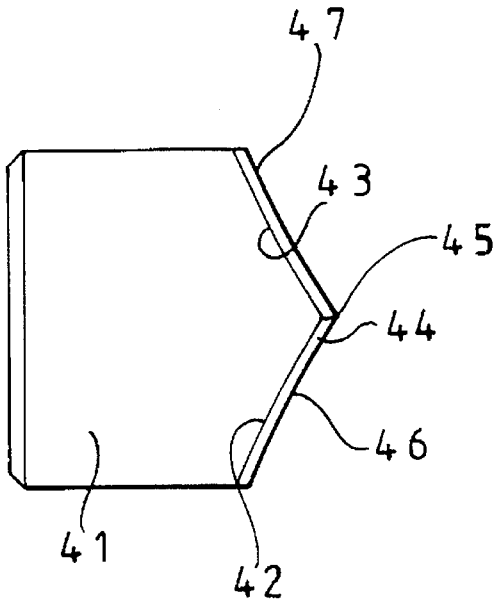
FIG 10
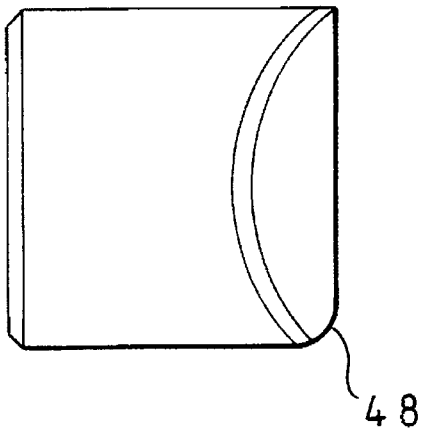
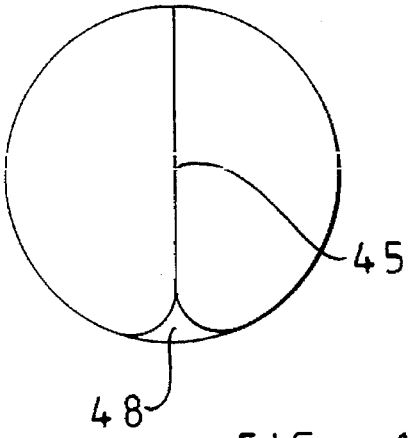
FIG 11

FIG 12
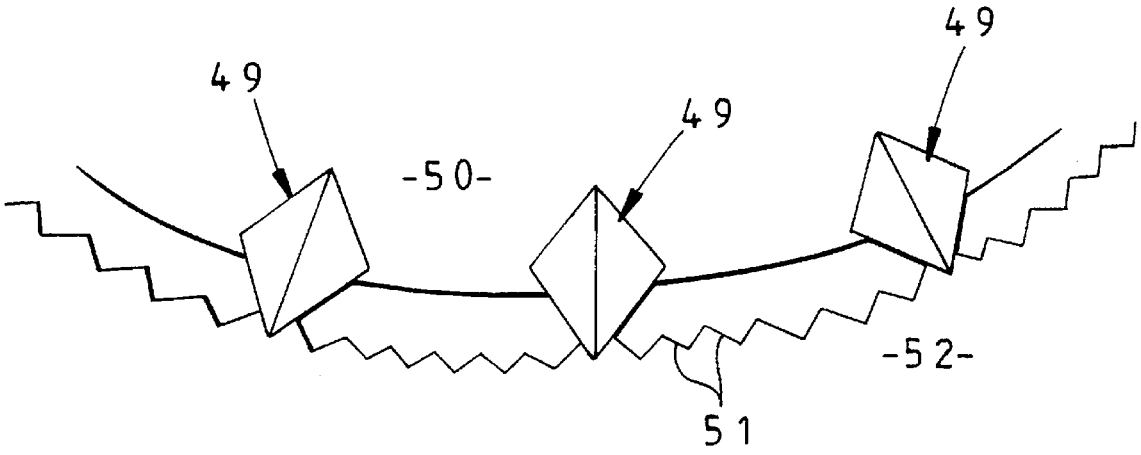
FIG 13
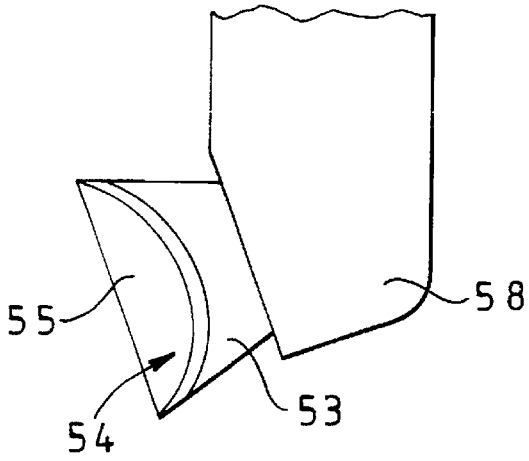
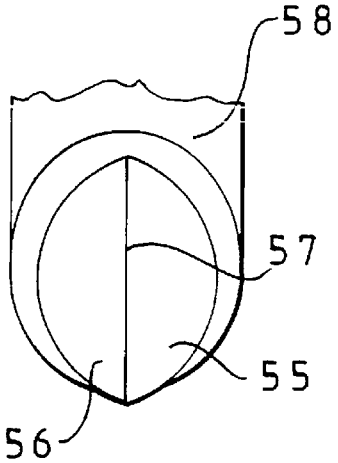
FIG 14

ROTARY DRILL BITS

BACKGROUND OF THE INVENTION

The invention relates to rotary drill bits of the kind comprising a bit body having a shank for connection to a drill string, a plurality of cutters mounted on the bit body, each cutter having a cutting face, and means for supplying drilling fluid to the surface of the bit body to cool and clean the cutters.

The invention is particularly, but not exclusively, applicable to drill bits in which some or all of the cutters are preform (PDC) cutters each formed, at least in part, from polycrystalline diamond. One common form of cutter comprises a tablet, usually circular or part-circular, made up of a superhard table of polycrystalline diamond, providing the from cutting face of the element, bonded to a substrate which is usually of cemented tungsten carbide.

The bit body may be machined from solid metal, usually steel, or may be moulded using a powder metallurgy process in which tungsten carbide powder is infiltrated with metal alloy binder in a furnace so as to form a hard matrix.

While such PDC bits have been very successful in drilling relatively soft formations, they have been less successful in drilling harder formations and soft formations which include harder occlusions or stringers. Although good rates of penetration are possible in harder formations, the PDC cutters may suffer accelerated wear and bit life can be too short to be commercially acceptable.

Studies have suggested that the rapid wear of PDC bits in harder formations is due to chipping of the cutters as a result of impact loads caused by vibration, and that the most harmful vibrations can be attributed to a phenomenon called "bit whirl". Bit whirl arises when the instantaneous axis of rotation of the bit precesses around the central axis of the hole when the diameter of the hole becomes slightly larger than the diameter of the bit. Bit whirl may be initiated, for example, when the drill bit meets a harder occlusion or stringer in the formation which obtrudes into the borehole, at least initially, in only one area of the bottom or sides of the borehole. As each cutter strikes the occlusion or harder formation the bit will try to rotate about the cutter which is for the time being restrained by the harder formation, thus initiating bit whirl.

When a bit begins to whirl some cutters can be moving sideways or backwards relative to the formation and may be moving at much greater velocity than if the bit were rotating truly. Once bit whirl has been initiated, it is difficult to stop since the forces resulting from the bit whirl, such as centrifugal forces, tend to reinforce the effect.

One method which has been employed to overcome the bit whirl is to design the drill bit so that it has, when rotating, an inherent lateral imbalance force which is relatively constant in direction and magnitude. The gauge structure of the bit body then includes one or more low friction bearing pads which are so located as to transmit this lateral imbalance force to the part of the formation which the bearing pad is for the time being engaging. The low friction bearing pad thus tends to slide over the surface of the formation which it engages, thereby reducing the tendency for bit whirl to be initiated.

However, this concept relies on a combination of the weight-on-bit and cutter layout to create the required out of balance force. The arrangement cannot therefore become operative to inhibit bit whirl until sufficient weight-on-bit is established. Furthermore, the necessary out of balance force results in excessive friction between the gauge and the walls of the borehole.

In an alternative approach, bits have been designed in a manner to provide a structure which constrains the bit to rotate truly, i.e. with the axis of rotation of the bit coincident with the central axis of the borehole. One such approach is described in Patent Specification No. WO 93/13290.

In PDC bits the cutters are normally arranged in spiral arrays with respect to the central axis of rotation of the bit so that the path swept by each cutter during each rotation overlaps the paths swept by other cutters disposed at slightly greater and slightly smaller radial distances from the bit axis. This provides an essentially smooth cutting profile to ensure that no part of the formation at the bottom of the borehole remains uncut. By contrast the above-mentioned specification proposes a cutter formation where the cutters, instead of being located in spiral formations, are disposed in concentric radially spaced arrays centred on the axis of rotation of the bit. In such an arrangement the cutters in each circular array sweep through essentially the same cutter path and the cutter paths of adjacent arrays do not overlap but are spaced apart in the radial direction. Consequently, the cutters define a series of concentric annular grooves in the cutting profile. As a result the cutters in each circular array cut a deep groove in the formation at the bottom of the borehole with annular ridges of uncut formation extending upwardly between the adjacent circular arrays of cutters.

The presence of the annular ridges increases significantly the vertical contact between the cutters and the formation so that any lateral force acting on the bit, whether externally generated or from cutting structure imbalance, is distributed over a larger contact area. This reduces the unit stress on the formation and the result of lower unit stress is said to result in less tendency for a cutter to bite laterally into the formation and initiate bit whirl.

However, this arrangement limits the depth of cut which can be achieved by individual cutters. This is known to be inefficient and studies have shown that deep cuts are more efficient and that cutter wear can actually increase at small depths of cut.

The present invention sets out to provide a new and improved form of drill bit in which the tendency for bit whirl to be initiated may be reduced, without the problems referred to with respect to the prior art bit stabilising arrangements.

SUMMARY OF THE INVENTION

According to the invention there is provided a rotary drill bit comprising a bit body having a shank for connection to a drill string a plurality of cutters mounted on the bit body, each cutter having a cutting face, and means for supplying drilling fluid to the surface of the bit body to cool and clean the cutters, at least certain of said cutters being lateral cutters located to act sideways, with respect to the central longitudinal axis of the drill bit, on the formation being drilled, the cutting faces of at least some of said lateral cutters being orientated to exhibit negative side rake and negative top rake with respect to the surface of the formation.

"Negative side rake" means that the cutting face of the cutter, as viewed along the longitudinal axis of the bit, is inclined forwardly in the normal direction of rotation of the bit, as it extends away from the formation. The negative side rake angle is the angle between the cutting face and a radial plane at right angles to the formation, as viewed along the longitudinal axis of the bit.

Similarly "negative top rake" means that the cutting face of the cutter, as viewed along a radius of the bit, is inclined forwardly in the normal direction of rotation of the bit, as it extends away from the formation. Again, the negative top rake angle is the angle between the cutting face and a radial plane at fight angles to the formation, as viewed along a radius of the bit.

The provision of negative side rake on the lateral cutters tends to inhibit the lateral cutting effect of the cutters on the formation. Consequently, the lateral cutters have an increased "bearing" effect on the formation which thus tends to stabilise the drill bit laterally and to inhibit the initiation of bit whirl.

By utilising the lateral cutters to stabilise the bit in the borehole, the axial length of the usual gauge portion of the drill bit may be reduced or the gauge portion might even be dispensed with, as will be described below.

Preferably the negative side rake angle is greater than 20° and in one preferred embodiment the negative side rake angle is 60°. However, the side rake angle may be as great as 90°, i.e. the cutting face may be substantially parallel to the surface of the formation which it engages. In this case the cutter has essentially no lateral cutting effect, and this may substantially increase bit stability.

Different lateral cutter cutting faces engaging the formation may have different negative side rake angles. For example, some cutting faces may have a negative side rake angle of 90° and other cutting faces may have a negative side rake angle of 20°. A single cutter may include two such cutting faces at different negative side rake angles, or the cutting faces may be provided on separate cutters.

In the case where a single cutter has two cutter faces at different negative side rake angles, the cutter may comprise a generally cylindrical substrate formed at one end with two oppositely inclined surfaces meeting along a ridge, a facing table of polycrystalline diamond, or other superhard material, being bonded to said substrate surfaces, and preferably extending continuously over the ridge.

The angle between the surfaces may be substantially 120° so that where one of the surfaces lies substantially tangentially to the surface of the bit body, for example the surface of a gauge pad on which the cutter is mounted, the other surface of the cutter has a back rake angle of about 30°. The outwardly facing surface of the cutter will resist abrasive ware and act to protect the cutting edge of the cutter from impact damage, to which gauge cutters are particularly prone.

At least one of said surfaces is preferably cylindrically curved about an axis parallel to said ridge, the radius of curvature corresponding substantially to the radial distance of the surface from the central longitudinal axis of the drill bit on which the cutter is mounted in use. Thus the curvature of the outward face of the cutter then corresponds generally to the curvature of the outer face of the gauge pad, or other part of the bit body on which it is mounted.

Preferably the ridge passes through the central longitudinal axis of the substrate, and preferably extends at fight angles thereto. The two surfaces are preferably substantially symmetrically arranged on each side of the ridge.

In order to further reduce the susceptibility of the cutter to impact damage, the junction between at least one end of the ridge and the outer surface of the substrate is preferably smoothly curved, for example is radiused.

Preferably the negative top rake angle of the lateral cutters is at least 20°.

Lateral cutters according to the invention may be so located on the cutting profile of the drill bit as to bear inwardly against a central core of formation extending upwardly from the bottom of the borehole.

Alternatively or additionally, lateral cutters according to the invention may be so located on the cutting profile as to bear outwardly against the formation forming the sides of the borehole.

(The "cutting profile" of the drill bit is an imaginary surface of revolution swept out by the curing edges of the cutters as the bit rotates (with zero rate of penetration)).

Preferably the lateral cutters are arranged in a stepped configuration where adjacent cutters are displaced both radially and axially relative to one another, with respect to the longitudinal axis of the drill bit.

In any of the above arrangements there may be additionally mounted on the bit body, at or adjacent the nose region thereof, a plurality of plough cutters each of which cutters comprises two cutting faces meeting at a forwardly facing ridge.

The nose region of the drill bit comprises the portion of the bit body which is lowermost when the bit is drilling vertically downwards. Depending on the shape of the bit body, the nose region may comprise a single central domed region, or it may comprise an annular region, extending around the central axis of the bit, which is domed in cross-section.

As previously described, a primary object of the present invention is to enhance the stability of a drill bit and the combination of plough cutters adjacent the nose of the bit with the cutter arrangements previously described will tend to enhance the stability of the bit still further, due to the tendency of plough cutters to resist lateral displacement of the bit body.

As previously mentioned, the increased stability of the drill bit may allow the conventional gauge section of the bit to be reduced in axial length or omitted all together. Accordingly, the invention also provides a drill bit of the kind first referred to where the bit lacks a passive gauge section, i.e. wherein the lateral and rotational stability of the drill bit is provided only by the engagement between the cutters and the formation, and there is no part of the periphery of the bit which bears on the formation and is devoid of cutters.

This aspect of the invention also includes drill bits which lack a passive gauge section, but where the stability of the bit is provided by other means, for example by the prior art concentric cutter arrangement referred to above.

Elimination of the conventional gauge section of the drill bit may reduce costs as well as reducing the bit length and the frictional restraint to rotation of the bit. It also may improve the steerability of the bit in directional drilling systems.

In rotary drill bits of the kind first referred to, the cutters are usually located at different distances from the central axis of rotation of the drill bit, to ensure that the entire surface of the bottom of the hole being drilled is acted on by the cutting elements, although, as previously mentioned, arrangements are also known where concentric annular regions of the bottom of the borehole are not acted on by the cutters. In all cases, however, cutters which are located further from the axis of rotation move more rapidly relative to the formation than cutters nearer the axis of rotation, and the overall annular area of formation swept by each such cutter is greater. As a result, cutters nearer the outer periphery of the drill bit tend to wear more rapidly than cutters nearer the axis of rotation, and in order to combat this it is the usual practice to position more cutters nearer the outer periphery. However, this results in decreased depth of cut in view of the increased cutter overlap. As mentioned above, studies have shown that deep cuts are more efficient and that cutter wear can increase at small depths of cut.

A further aspect of the present invention therefore provides a rotary drill bit construction whereby large depths of cut may be achieved, but where provision is made for the more rapid wear of cutters nearer the outer periphery of the drill bit.

According to this aspect of the invention, there is provided a rotary drill bit comprising a bit body having a shank for connection to a drill string, a plurality of cutters mounted on the bit body, and means for supplying drilling fluid to the surface of the bit body to cool and clean the cutters, said cutters including a number of primary cutters towards the outer periphery of the drill bit each having associated therewith at least one back-up cutter which is positioned at substantially the same radial distance from the central longitudinal axis of the drill bit as its associated primary cutter, but is displaced vertically with respect to said primary cutter.

In a drill bit of this kind the radial spacing of the cutters nearer the outer periphery can be greater than with prior art drill bits so that these cutters can achieve greater, and hence more efficient depth of cut. This leads to more rapid wear of the primary cutter, but when the primary cutter fails the associated back-up cutters come into play in succession, so as to continue cutting the formation at large depths of cut.

This arrangement is liable to result in greater cutter loads and for this reason a stable bit design is required. This aspect of the invention is therefore particularly suitable for combination with the stabilising features of the earlier aspects of the invention. However, this aspect of the invention may also be used in combination with other, prior art bit stabilising systems.

Preferably at least certain of said primary cutters have a plurality of said back-up cutters associated therewith, the back-up cutters being displaced vertically by different distances with respect to their associated primary cutter. Primary cutters further from the axis of rotation of the drill bit may have associated therewith a greater number of back-up cutters than primary cutters nearer the axis of rotation.

Preferably substantially all the cutters on the drill bit within a predetermined range of radial distances from the axis of the drill bit are primary cutters having associated back-up cutters.

Preferably each back-up cutter is of substantially the same construction, shape and configuration as its associated primary cutter.

In this aspect of the invention, and also in the previous aspects, each cutter may be a preform PDC cutter comprising a tablet, for example circular or part-circular, made up of a superhard table of polycrystalline diamond, providing the front cutting face of the element, bonded to a substrate of less hard material such as cemented tungsten carbide.

BRIEF DESCRIPTION OF THE DRAWINGS

FIG. 4 is a diagrammatic horizontal section through an alternative form of cutter, FIG. 5 is a perspective view of the cutter of FIG. 4, FIG. 6 is a similar view to FIG. 4 showing the cutter in a different disposition, FIG. 7 is a diagrammatic longitudinal half-section through another form of drill bit in accordance with the invention, FIG. 8 shows diagrammatically the cutter configuration on a further form of drill bit according to the invention, FIG. 9 is a plan view of a further form of cutter for use in the present invention, FIG. 10 is a side elevation of the cutter of FIG. 9, FIG. 11 is a front elevation of the cutter of FIG. 9, FIG. 12 is a diagrammatic front elevation of part of a drill bit illustrating the use of plough cutters, FIG. 13 is a side elevation of a typical plough cutter, and FIG. 14 is a front elevation of the cutter of FIG. 13.

DETAILED DESCRIPTION OF THE PREFERRED EMBODIMENTS

Figure 1:
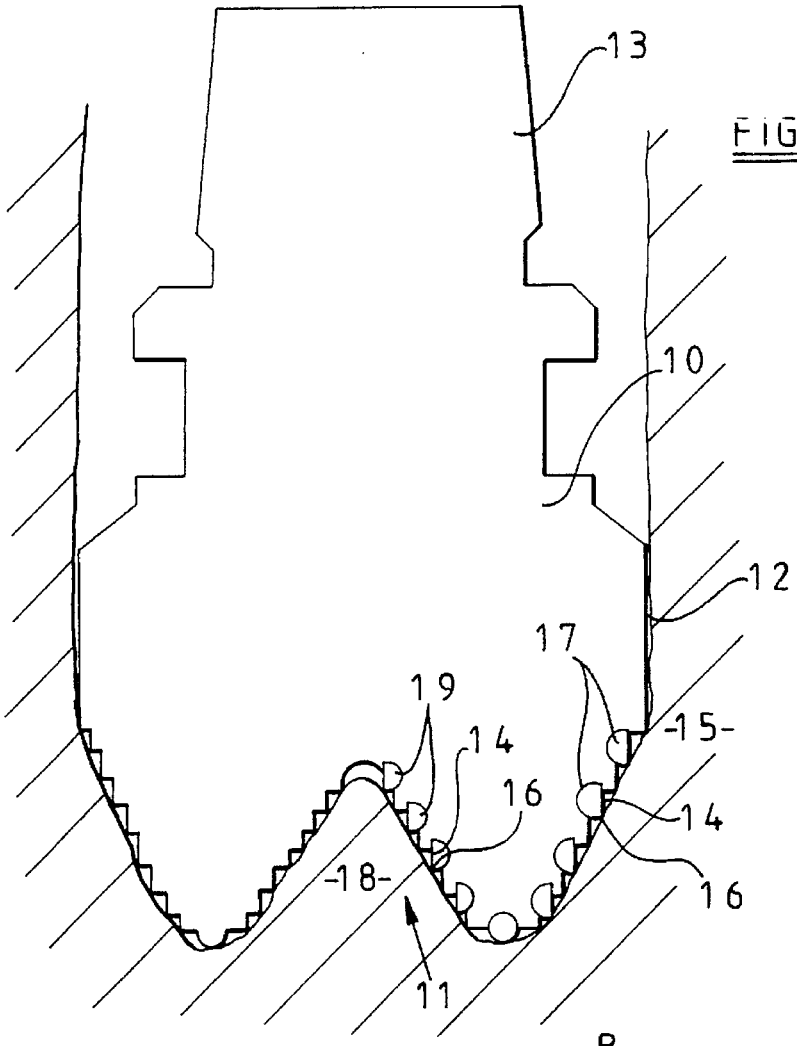
FIG. 1 is a diagrammatic longitudinal section through one form of drill bit in accordance with the invention.

FIG. 1 shows diagrammatically a step-type rotary drill bit for use in drilling deep holes in subsurface formations. The drill bit comprises a bit body 10 having a leading face 11 and a gauge region 12. The bit body is machined from steel and has a tapered threaded shank 13 for connection to a drill string.

The leading face 11 of the drill bit is formed with a generally conical recess around which are arranged arrays of PDC cutters arranged in a stepped configuration, in known manner.

Similarly the outer peripheral surface of the leading face of the bit body is generally conical in shape and has part-circular PDC cutters mounted on it in a stepped configuration.

In known manner, each PDC cutter comprises a cutting table of polycrystalline diamond bonded to a substrate of cemented tungsten carbide. The substrate is either mounted directly in a socket in the body or is brazed to a post or stud which is, in turn, received in a socket in the bit body.

As may be seen from FIG. 1, each cutter is pan-circular and has a generally vertical straight cutting edge 14 which bears laterally on the surface of the formation 15 and a horizontal cutting edge 16 which bears downwardly on the formation. The cutting elements bearing laterally outwardly against the formation are indicated at 17 and the cutting elements beating inwardly on a central conical formation 18 on the bottom of the borehole are indicated at 19.

Figure 2:
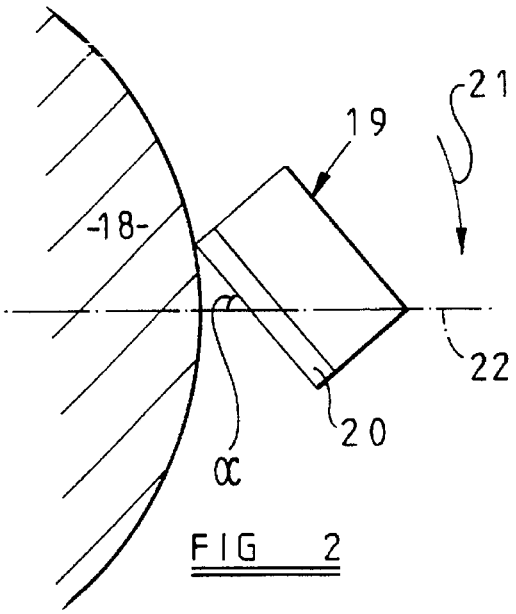
FIG. 2 is a diagrammatic horizontal section through one of the cutters of the drill bit.

FIG. 2 is a horizontal section through one of the cutting elements 19 which bears against the formation in the central conical projection 18 on the bottom of the borehole. As may be seen from FIG. 2 the cutter 19 is so orientated on the bit body as to exhibit negative side rake. That is to say, the cutting face 20 of the cutter, as viewed along the longitudinal axis of the bit, is inclined forwardly in the normal direction of rotation of the bit (indicated by the arrow 21) as it extends away from the formation 18. The negative side rake angle $\alpha$ is the angle between the cutting face 20 and a radial plane 22 at fight angles to the formation 18.

Figure 3:
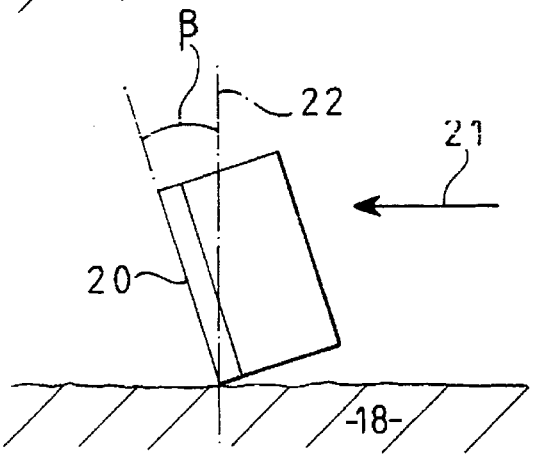
FIG. 3 is a diagrammatic vertical Section through the cutter, cutter.

FIG. 3 is a vertical section through the cutter 19 and it will be seen that the cutter is so orientated on the bit body as to exhibit negative top rake, i.e. the cutting face 20 of the cutter, as viewed along a radius of the bit, is inclined forwardly in the normal direction of rotation of the bit (indicated by the arrow 21) as it extends away from the formation 18. The negative top rake angle β is the angle between the cutting face 20 and the radial plane 22 at fight angles to the formation.

The negative side rake angle is preferably greater than 20° and, as will be described below, may be as great as 90°. The negative top rake angle is preferably at least 20°.

The provision of negative side rake on the cutters tends to inhibit the lateral cutting effect of the cutters on the formation. Consequently, the cutters have an increased "bearing" effect on the formation which they engage, and less "cutting" effect, which tends to stabilise the drill bit in the borehole and to inhibit the initiation of the bit whirl. The effect is likely to be most efficient when applied to the inwardly directed cutters 19 in a drill bit of the kind shown in FIG. 1 where the cutting profile has a central substantially conical depression since the provision of such conical profile tends, in any case, to stabilise the drill bit in the borehole. However, as shown, the negative side rake and top rake may also be applied to outwardly directed cutters and this may be done, not only in a drill bit of the configuration shown in FIG. 1, but also in drill bits where the cutting profile is not formed with a central conical depression.

FIG. 4 is a similar view to FIG. 2 of an alternative construction. In this case the cutter 23 is formed with two cutting faces 24, 25 arranged at an angle to one another. Both curing faces comprise parts of a cutting table of polycrystalline diamond bonded to a tungsten carbide substrate 26.

As shown in FIG. 4, the cutter 23 is so orientated on the bit body that the leading cutting face 24 has a negative side rake angle of approximately 20° or more, whereas the trailing cutting face 25 has a negative side rake angle of substantially 90°. That is to say, the cutting face 25 is arranged substantially tangentially to the curved surface of the formation 27. In this case, therefore, the cutter has very little lateral cutting effect on the formation 27 and performs largely a "bearing" function whereby the engagement of the cutter with the formation tends to stabilise the bit in the borehole. The cutter 23 is shown in perspective in FIG. 5.

In the arrangement of FIG. 4 the cutter 23 is an inwardly facing cutter and FIG. 6 shows the alternative arrangement where a similar cutter 28 faces outwardly and bears against the formation 29 forming the side walls of the borehole.

FIGS. 4–6 show only one form of cutter having two angled cutting faces and it will be appreciated that other configurations may be employed. Also, the two cutting faces at different side rake angles may be provided on entirely separate cutters located at different places around the leading face of the drill bit. The combined effect of the separate cutters will however be substantially the same as the cutter shown in FIGS. 4–6.

In any of the arrangements according to the invention, the stability of the drill bit in the borehole will be substantially enhanced, and the enhancement may be sufficient to enable the conventional gauge region of the drill bit to be dispensed with. A drill bit without such a gauge section is shown diagrammatically in FIG. 7. In this case the cutters 30, 30A mounted on the bit body 31 around the outer periphery of the drill bit are so orientated as to exhibit negative side rake and negative top rake, as previously described. This applies to the cutters 30 mounted on a generally conical lower part of the bit body as well as to other cutters 30A mounted on a generally cylindrical part of the bit body 31 above the cutters 30.

FIG. 8 illustrates diagrammatically another aspect of the present invention and is a conventional diagrammatic representation showing the relative disposition of cutters on a drill bit in a manner to illustrate the cutting profile. In other words the cutters shown diagrammatically in FIG. 8 are actually distributed in different locations over the bit body but FIG. 8 shows their relative radial and vertical positions to form the cutting profile.

As will be seen from FIG. 8 the cutting profile is partly defined by five inner part-circular cutters 32 arranged in a generally conical pattern over the bit body so as to form an inner frusto-conical upstanding core or projection from the bottom of the borehole being drilled. Outwardly of the cutters 32 is a series of circular cutters 33 which form the lowermost part of the borehole bottom. Radially outwardly of the cutters 33 is another series of part-circular cutters 34.

As previously explained, cutters nearer the outer periphery of the drill bit tend to wear more rapidly than cutters nearer the axis of rotation 35, and these outer cutters are indicated at 36. In accordance with this aspect of the invention the outer cutters 36 comprise four primary cutters 37 which perform the initial cutting of the formation. However, associated with each primary cutter 37 are one or more back-up cutters 38 which are positioned at substantially the same radial distance from the axis 35 of the bit but are displaced vertically with respect to the primary cutter. The number of back-up cutters increases from one with the two innermost primary cutters to three with the outermost primary cutter 37, the multiple back-up cutters being arranged at different vertical spacings from the primary cutter.

In the arrangement of FIG. 8, the radial spacing of the outer cutters 36 is somewhat greater than is normally the case with prior art drill bits and this allows these outer cutters to achieve greater and hence more efficient depth of cut. Although this leads to more rapid wear of the primary cutters, the associated back-up cutters 38 come into play as each primary cutter fails so as to continue cutting the formation at a large and hence efficient depth of cut.

The arrangement of FIG. 8 is particularly suitable for use with the stabilising arrangements previously described, however the back-up cutter arrangement may also be provided with prior art drill bits where the stability of the drill bit in a borehole is effected by other means.

FIGS. 9 to 11 illustrate a modified version of the cutter of FIGS. 4 to 6, the cutter being of a type to provide increased resistance to impact damage. The cutter comprises a generally cylindrical circular cross-section substrate 41 formed, for example, from cemented tungsten carbide. One end of the substrate is formed with two oppositely inclined surfaces 42, 43 arranged at an angle of 120° to one another. Bonded across the surfaces 42, 43 is a facing table 44 of polycrystalline diamond which extends over the ridge 45 between the surfaces 42 and 43. The facing table 44 provides two inclined facing surfaces 46 and 47.

In use, the cutter of FIGS. 9 to 11 is mounted on the drill bit in similar manner to that shown in FIG. 4 or FIG. 6 so that one of the faces 46, 47 bears substantially tangentially against the formation while the other face is disposed at a back rake angle of approximately 30°.

One or both of the from faces 46, 47 is cylindrically curved about an axis parallel to the forwardly facing ridge 45 of the cutter. In the case where the cutter is for mounting in the gauge region of the drill bit, the radius of curvature of the curved surface is approximately equal to the distance of the surface from the central axis of rotation of the drill bit so that the surface is of substantially corresponding curvature to the surface of the gauge pad on which it is mounted. This tends to reduce the abrasive effect of the surface on the formation which it engages and also reduces the susceptibility of the cutter to damage by impact.

In order to further reduce the risk of damage by impact on the cutter, the lower end of the ridge 45 of the cutter is radiused as indicated at 48 in FIGS. 10 and 11.

As previously mentioned, the stability of a drill bit according to the present invention may be further enhanced by also using on the drill bit plough cutters located in the region of the nose of the bit. Such an arrangement is shown in FIGS. 12 to 14.

In FIG. 12, plough cutters 49 are mounted on the bit body 50 around the lowermost annular nose portion of a crown bit. As indicated diagrammatically in FIG. 12, the plough cutters create V-section annular grooves 51 in the formation 52 at the bottom of the borehole and, due to their shape, the grooves tend to keep the plough cutters in an annular path thus enhancing the lateral stability of the bit.

If plough cutters are used on the flanks of the bit body they have the effect of cutting a "screw thread" in the formation, which may also enhance the axial stability of the bit.

FIGS. 13 and 14 show a typical plough cutter in greater detail. The cutter comprises a tapered tungsten carbide substrate 53 to which is bonded a polycrystalline diamond facing table 54, the substrate being so shaped that the facing table 54, which is of constant thickness, provides a cutting face which comprises two cutting surfaces 55, 56 which are symmetrically arranged on opposite sides of a central forwardly facing ridge 57. The cutter is bonded, for example by brazing, to a post 58 which is secured within a socket in the bit body.

We claim:

1. A rotary drill bit, for drilling a borehole in a subsurface formation, comprising a bit body having a shank for connection to a drill string, a plurality of cutters mounted on the bit body, each cutter having a cutting face, and means for supplying drilling fluid to the surface of the bit body to cool and clean the cutters, at least certain of said cutters being lateral cutters located to act sideways, with respect to the central longitudinal axis of the drill bit, on the formation forming the sidewall of the borehole being drilled, the cutting faces of at least some of said lateral cutters being orientated to exhibit negative side rake and negative top rake with respect to the surface of said formation forming the sidewall of the borehole.

2. A drill bit according to claim 1, wherein the negative side rake angle, defined as the angle between the cutting face of a cutter and a radial plane at right angles to the formation, as viewed along the longitudinal axis of the bit, is greater than 20°.

3. A drill bit according to claim 1, wherein the negative side rake angle, defined as the angle between the cutting face of a cutter and a radial plane at right angles to the formation, as viewed along the longitudinal axis of the bit, is 60°.

4. A drill bit according to claim 1, wherein the negative side rake angle, defined as the angle between the cutting face of a cutter and a radial plane at right angles to the formation, as viewed along the longitudinal axis of the bit, is 90°.

5. A drill bit according to claim 1, wherein different lateral cutter cutting faces engaging the formation have different negative side rake angles.

6. A drill bit according to claim 5, wherein at least one single cutter includes two cutting faces at different negative side rake angles.

7. A drill bit according to claim 6, wherein the single cutter comprises a generally cylindrical substrate formed at one end with two oppositely inclined surfaces meeting along a ridge, a facing table of polycrystalline diamond, or other superhard material, being bonded to said substrate surfaces, and preferably extending continuously over the ridge.

8. A drill bit according to claim 7, wherein the angle between the surfaces is substantially 120° so that where one of the surfaces lies substantially tangentially to the surface of the bit body the other surface of the cutter has a back rake angle of about 30°.

9. A drill bit according to claim 7, wherein at least one of said surfaces is cylindrically curved about an axis parallel to said ridge, the radius of curvature corresponding substantially to the radial distance of the surface from the central longitudinal axis of the drill bit on which the cutter is mounted in use.

10. A drill bit according to claim 7, wherein the ridge passes through the central longitudinal axis of the substrate, and extends at right angles thereto.

11. A drill bit according to claim 7, wherein the two surfaces are substantially symmetrically arranged on each side of the ridge.

12. A drill bit according to claim 7, wherein the junction between at least one end of the ridge and the outer surface of the substrate is smoothly curved.

13. A drill bit according to claim 1, wherein the negative top rake angle of the lateral cutters, defined as the angle between the cutting face of a cutter and a radial plane at right angles to the formation, as viewed along a radius of the bit, is at least 20°.

14. A drill bit according to claim 1, wherein at least certain of said lateral cutters are so located on the cutting profile of the drill bit as to bear inwardly against a central core of formation extending upwardly from the bottom of the borehole.

15. A drill bit according to claim 1, wherein at least certain of said lateral cutters are so located on the cutting profile as to bear outwardly against the formation forming the sides of the borehole.

16. A drill bit according to claim 1, wherein the lateral cutters are arranged in a stepped configuration where adjacent cutters are displaced both radially and axially relative to one another, with respect to the longitudinal axis of the drill bit.

17. A drill bit according to claim 1, wherein there are additionally mounted on the bit body, at or adjacent the nose region thereof, a plurality of plough cutters each of which cutters comprises two cutting faces meeting at a forwardly facing ridge.

18. A rotary drill bit comprising a bit body having a surface and a shank for connection to a drill string, a plurality of cutters mounted on the bit body, and means for supplying drilling fluid to said surface of the bit body to cool and clean the cutters, said cutters including a number of primary cutters towards the outer periphery of the drill bit each having associated therewith at least one back-up cutter which is positioned at substantially the same radial distance from the central longitudinal axis of the drill bit as its associated primary cutter, but is displaced vertically with respect to said primary cutter.

19. A drill bit according to claim 18, wherein at least certain of said primary cutters have a plurality of said back-up cutters associated therewith, the back-up cutters being displaced vertically by different distances with respect to their associated primary cutter.

20. A drill bit according to claim 19, wherein primary cutters further from a longitudinal axis of rotation of the drill bit have associated therewith a greater number of back-up cutters than primary cutters nearer the axis of rotation.

21. A drill bit according to claim 18, wherein substantially all the cutters on the drill bit within a predetermined range of radial distances from the axis of the drill bit are primary cutters having associated back-up cutters.

22. A drill bit according to claim 18, wherein each cutter is a preform PDC cutter comprising a tablet made up of a superhard table of polycrystalline diamond, providing a front cutting face of the element, bonded to a substrate of less hard material.

23. A drill bit according to claim 22, wherein each back-up cutter is of substantially the same construction, shape and configuration as its associated primary cutter.

* * * * *